United States Patent [19]

Andersen et al.

[11] Patent Number: 4,858,352

[45] Date of Patent: Aug. 22, 1989

[54] MEANS FOR IDENTIFYING THE PARENTAGE AND PERFORMANCE CHARACTERISTICS OF SEED

[75] Inventors: Gerald L. Andersen; Ronald D. Howes, both of Cedar Rapids; Richard D. Meyocks, Fairfax, all of Iowa

[73] Assignee: Pioneer Hi-Bred International, Inc., Des Moines, Iowa

[21] Appl. No.: 112,530

[22] Filed: Oct. 26, 1987

[51] Int. Cl.[4] ..... G09F 3/100

[52] U.S. Cl. ..... 40/299

[58] Field of Search ..... 40/10 C, 2 R, 645

[56] References Cited

U.S. PATENT DOCUMENTS

| | | | |
|---|---|---|---|
| 4,027,410 | 6/1977 | Wheeler | 40/10 C |
| 4,079,530 | 3/1978 | Atherton et al. | 40/10 C |
| 4,304,059 | 12/1981 | Tisbo et al. | 40/10 C |
| 4,407,082 | 10/1983 | Stehouwer | 40/10 C |

OTHER PUBLICATIONS

Asgrow Seed Planting Guide, 1977.
Pioneer Seeds Booklet, 1975.
Eastland Seed Booklet, 1980.

*Primary Examiner*—Robert Peshock
*Assistant Examiner*—Michael Lynch
*Attorney, Agent, or Firm*—Zarley, McKee, Thomte, Voorhees & Sease

[57] ABSTRACT

A rectangular sheet member or tag is provided which has a top, bottom, and opposite sides. A pair of horizontally disposed juxtapositioned colored bars appear adjacent the top of the tag with each bar and the colors thereof symbolizing the inbred parentage of the hybrid.

A variety denomination such as a number of several digits is assigned to the hybrid seed and this number appears preferably below the parentage bars along with a notation pertaining to the maturity rating of the hybrid.

Vertically disposed indicia means appears along one side edge of the sheet member with numerals of progressively increasing magnitude. A plurality of separate vertically extending bars extends upwardly from the bottom of the tag adjacent the indicia means with the length of each of the bars representing the evaluation of different characteristics of the hybrid. Preferably, the color of the male parent of this seed is the same color as the vertical bars which reflect the characteristics of the seed.

A tag for seed of a given variety or hybrid is affixed to the bags containing such seed. Replicas of a plurality of tags for a plurality of variations of seed are easily placed in published form to permit a rapid comparison of varieties including instant access to the characteristics of each hybrid as well as the parentage thereof.

24 Claims, 1 Drawing Sheet

MEANS FOR IDENTIFYING THE PARENTAGE AND PERFORMANCE CHARACTERISTICS OF SEED

BACKGROUND OF THE INVENTION

The production of hybrid field seeds is a complex and sophisticated art. Simply stated, this art involves the development of two inbred parents which are crossed as male and female to produce the hybrid seed to be grown by the farmer. Each of the parent inbreds bring certain characteristics to the hybrid. The crossing of different combinations of inbred parents results in hybrid seed having different plant characteristics when grown. In the case of corn, for example, the pollen from the tassels of the male parent are permitted to pollinate the silks of the ears of the female parent which is not permitted to provide pollen. This general art has substantially enhanced and increased the yield potential of many farm seeds, such as corn and sorghum, since its advent in the 1920's.

Conventionally, hybrid seed is assigned a variety denomination, such as a number of several digits, and these numbers serve to identify the hybrids for both the producer and the farmer purchasing the seed. These numbers characterisically are printed on the seed bags and on tags affixed to the bags. Similarly, these numbers also appear in a producer's brochures and sales material which usually include detailed information concerning the characteristics of the hybrid in question.

There are a plurality of factors that a farmer normally takes into account in selecting a hybrid or variety. For example, in selecting a corn hybrid, a farmer may take into account such factors as the length of the growing season, the anticipated weather conditions of the growing season, and the use to which the resulting crop will be put (i.e., forage or shelled corn). The grower will make his hybrid selection on the basis of what hybrids have the most desirable characteristics for his needs. He may know from prior experience that a given variety may provide at least some of the characteristics which he desires. However, because of the complexity of the process, it is virtually impossible for the average purchaser to mentally retain the plurality of performance data for a plurality of hybrids having different combinations of inbred parents. As a result, recourse is typically made to the producer's manuals which contain the desired information on the different hybrid varieties.

While this process ultimately reveals the desired information, it is time consuming and inefficient. Further, the detailed information needed has heretofore not been available on the hybrid seed bag itself, and this is particularly true of any comparative information between hybrid varieties. Identification of inbred parentage is rarely, if ever, revealed in even the producer's informational publications. As a result, despite the great improvement in the performance of hybrid crops such as corn, a means for instanteously providing the parentage and key characteristics of a hybrid seed on the seed bag has been lacking.

SUMMARY OF THE INVENTION

A rectangular sheet member or tag is provided which has a top, bottom, and opposite sides. A pair of horizontally disposed juxtapositioned colored bars appear adjacent to the top of the tag with each bar and the colors thereof symbolizing the inbred parentage of the hybrid.

A variety denomination, such as a number of several digits, is assigned to the hybrid seed. This number appears preferably below the parentage bars along with a notation pertaining to the maturity rating of the hybrid.

Vertically disposed indicia means appears along one side edge of the sheet member with numerals of progressively increasing magnitude. A plurality of separate vertically extending bars extends upwardly from the bottom of the tag adjacent the indicia means with the length of each of the bars representing the evaluation of different characteristics of the hybrid. Preferably, the color of the male parent of this seed is the same color as the vertical bars which reflect the characteristics of the hybrid variety when grown.

A tag for seed of a given variety or hybrid is affixed to the bags containing such seed. Replicas of a plurality of tags for a plurality of variations of seed are easily placed in published form to permit a rapid comparison of varieties including instant access to some of the characteristics of each hybrid as well as the parentage thereof.

Therefore, it is an object of this invention to provide a means for identifying some performance characteristics of hybrid seed which will permit an instant visual revelation of the key characteristics of the hybrid which the grower will plant.

A further object of the invention is to provide a means for identifying the parentage and key characteristics of a hybrid which will permit an instant visual revelation of the parentage and key characteristics of the hybrid seed which can be affixed to the bag containing the seed.

A further object of the invention is to provide a means for identifying the parentage and growing characteristics of hybrid seed which will permit an instant visual revelation of the parentage and growing characteristics of the hybrid seed which will permit ease in comparing both the parentage and characteristics of hybrids in printed publications and the like.

These and other objects will be apparent to those skilled in the art.

DESCRIPTION OF THE PREFERRED EMBODIMENT

Figure 1:
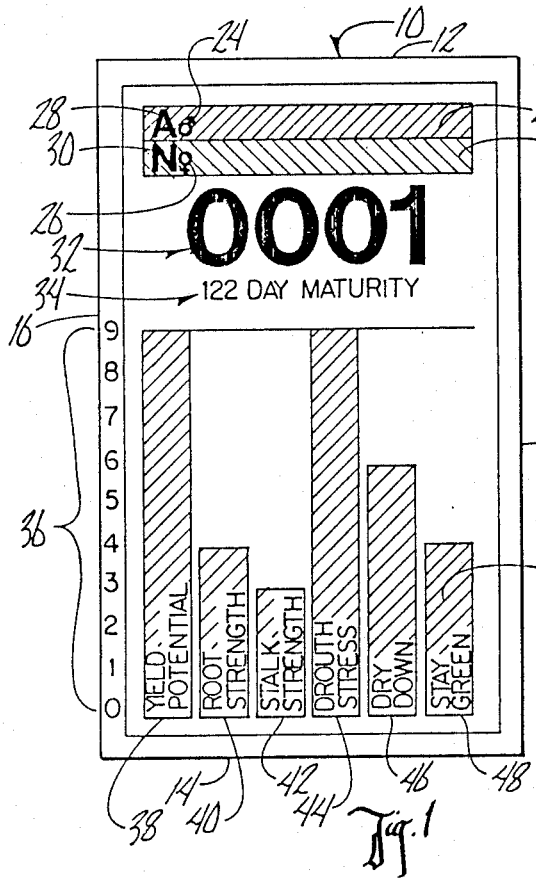
FIG. 1 is an elevational view of the front of a tag member for a given variety of hybrid seed corn showing both its parentage and its growing characteristics. The drawing is lined for color.

The numeral 10 designates a tag or sheet member used in identifying a variety of hybrid seed corn. The numeral 10A (FIG. 2) and the numerals 10B–10N, and 10P (FIG. 4) show tags for other varieties of hybrid seed corn. Each of the tags has a top 12, a bottom 14, a left-hand side 16, and a right-hand side 18.

Figure 2:
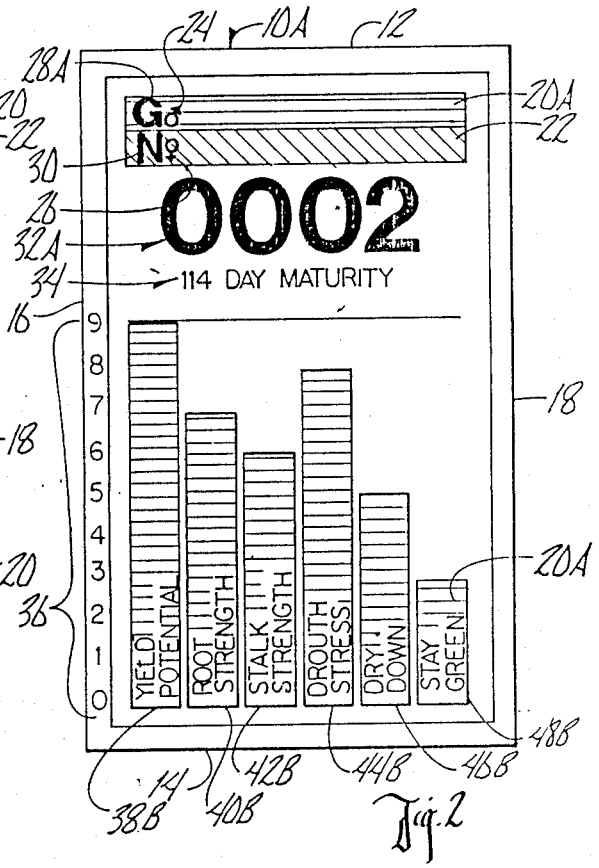
FIG. 2 is a tag member similar to that of FIG. 1 but showing the parentage and growing characteristics of a related but different hybrid seed.

Tag 10 has a horizontal bar 20 parallel to and closely spaced from the top 12. Bar 20 represents the male inbred used in creating the hybrid seed contemplated by tag 10. Bar 20 is specially colored (brown) and this color is used on every tag where that specific male inbred is utilized. The numeral 20A represents a corresponding male inbred bar on card 10A in FIG. 2. Similarly, a horizontal bar 22 is located on card 10 immediately below bar 20. This bar designates the female parent for the hybrid in question and carries a special color (green) to identify the specific female inbred being used. The male inbred bars 20 and the female inbred bars 22 (as well as male and female inbred bars of different colors on other tags) each carry, respectively, the male and female symbols 24 and 26. Each male and female inbred carries an identifying symbol, such as the letter A for male inbred bar 20 (see numeral 28); the letter N for female inbred bar 22 (see numeral 30); and the letter G for male inbred bar 20A (see numeral 28A in FIG. 2). With reference to FIGS. 1 and 2, it is seen that whenever an inbred parent is used in the creation of a hybrid variety, the inbred parent bar retains the same color and the same identifying letter (see female inbred bar 22 in FIGS. 1 and 2).

Every hybrid variety created by a given combination of inbred male and female parents is given a special denomination, such as a variety number. See the number 0001 on tag 10 of FIG. 1 (see numeral 32) and the number 0002 on the tag 10A of FIG. 2 (see numeral 32A). A statement or caption pertaining to the maturity of the hybrid (i.e., the relative period between planting and maturity for harvest) is preferably located directly below the variety number. See the numerals 34 in FIGS. 1 and 2.

An indicia scale 36 is vertically disposed along the lower side 16 of each tag and is preferably comprised of a scale from 1 through 9 as shown in FIGS. 1 and 2. The higher numbers on the scale represent a more desirable evaluation of the characteristics of the hybrid, with lower numbers representing a less desirable evaluation. A plurality of vertically disposed bars 38, 40, 42, 44, 46 and 48 extend vertically from adjacent the bottom 14 of the tag 10, with all bars extending from the lower end of the scale 36 on a horizontal line from the lower end of the scale. These bars 38 through 48 can be used to designate the evaluation of the characteristics of the hybrid in question pertaining to yield potential, root strength, stalk strength, drought stress, "dry down", and "stay green", respectively. The bars 38 through 48 can be of the same or different length with respect to scale 36, depending upon the degree to which they fulfill the highest evaluation at the top end of indicia scale 36. Corresponding bars 38B through 48B representing the same characteristics as bars 38 through 48, are shown on tag 12 of FIG. 2 to reflect the various characteristics of the hybrid depicted by that tag. With all tags, it is preferred that the color of the characteristic bars 38 through 48, and 38B through 48B, bear the color of the male parent. Thus, bars 38 through 48 of FIG. 1 are colored brown to correspond to the male inbred bar 20; and the characteristic bars 38B through 48B of FIG. 2 are colored blue to correspond to the blue male inbred bar 20A. The colors of the cards 10 and 12 are preferably the same and typically would be white or at least a common color contrasting with the colors of the inbred bars.

Figure 3:
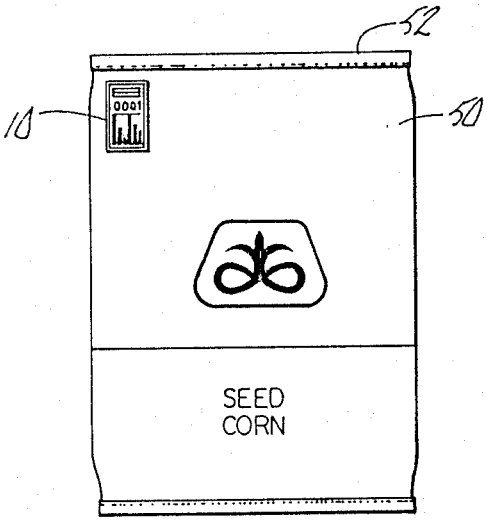
FIG. 3 is a front elevational view at a smaller scale of a seed corn bag showing the tag of FIG. 1 affixed thereto.

A typical seed bag 50 is depicted in FIG. 3 and shows the tag 10 stapled or glued to the bag adjacent the top 52 thereof for easy visual access to anyone desiring information concerning the hybrid seed in the bag.

Figure 4:
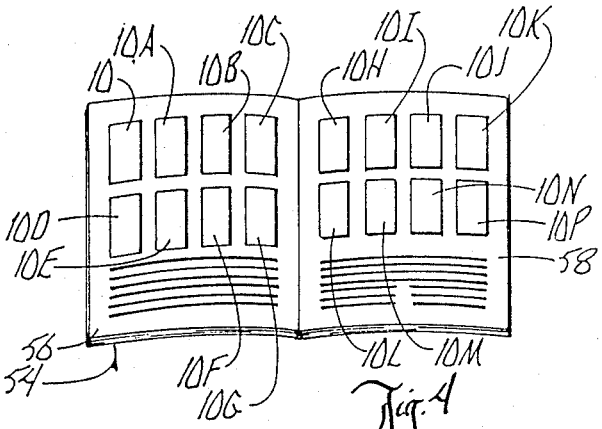
FIG. 4 is an elevational view of two opposed sheets in a typical producer's manual showing how a plurality of tags of the type shown in FIGS. 1 and 2, and others, can be depicted for comparative purposes.

A typical hybrid producer's brochure or publication 54 is shown in FIG. 4 having opposite pages 56 and 58. A plurality of tags 10–10N and 10P are depicted therein to illustrate how a plurality of hybrid seed tags can be juxtapositioned in a publication or the like for quick comparison purposes.

It is seen that each of the tags disclosed herein will quickly reveal the inbred parentage of the hybrid, the hybrid number and its maturity period. At the same time, the characteristic bars at the bottom of each tag, all of which bear the color the male inbred parent, quickly provide tee relative quality or strength of each of the characteristics as manifested on the indicia scale 36.

In the seed selection process before planting, the farmer can quickly and easily evaluate the characteristics of various hybrids by viewing a publication such as that shown in FIG. 4. The color system used on the tags will enable one to easily track the presence of a given inbred parent through the various hybrid varieties. Thus, for example, if a farmer had planted hybrid variety 0002 (see FIG. 2) in the previous year, and was satisfied with the variety but wanted a hybrid having greater adaptability to drought stress, he might easily be led to hybrid variety 0001 of FIG. 1 through the common color code of the inbred female bars 22 which reveals that this characteristic in hybrid 0001 is better than that in hybrid variety 0002. While some of the other characteristics in hybrid 0001 are not as strong as that of hybrid variety 0002, the relative strengths of the characteristics of the two hybrids is quickly and easily visually ascertainable.

If the farmer has access only to the bag 50, the tag 10 will immediately provide him with vital information pertaining to the hybrid seed in the bag. It is common for farmers to save a representative seed bag or tag even after the seed has been planted, so the tag 10 will continue to serve as a means of useful data and identification for the seed which has been planted. This system is particularly useful when a large farming operation characteristically will plant several different hybrids in several different fields.

Thus, from the foregoing, it is seen that this invention will achieve at least its stated objectives.

We claim:

1. A means for identifying the parentage and performance characteristics of seed comprising, a rectangular tag member having a top, bottom and opposite sides, a pair of symbols on said tag member identifying the male and female parentage of the seed being identified, longitudinally disposed indicia means on said tag member with numeric indicia of progressively increasing magnitude, a plurality of separate bars on said tag member extending longitudinally adjacent said indicia means, each of said bars representing a different growing characteristic of the seed being identified, the length of each of said bars coinciding with a number or fractional number of said indicia means corresponding to a predetermined performance rating of the specific characteristics of said seed represented by each of said bars.

2. The means of claim 1 wherein said pair of symbols are horizontally disposed juxtapositioned bars.

3. The means of claim 2 wherein at least one of said juxtapositioned bars are colored, and said plurality of separate bars have the same color as said colored juxtapositioned bar.

4. The means of claim 1 wherein said longitudinally disposed indicia means, and said bars adjacent thereto are vertically positioned on said tag member.

5. The means of claim 1 wherein said indicia means is positioned adjacent one side of said tag member.

6. The means of claim 1 wherein said symbol for said male parent of the seed being identified being colored, and said bars having the same color as the symbol for said male parent.

7. The means of claim 1 wherein a hybrid variety identification denomination is imposed on said tag member.

8. The means of claim 1 wherein a maturity rating of the hybrid seed being identified is imposed on said tag member.

9. The means of claim 1 wherein said tag member is affixed to a bag containing said seed.

10. The means of claim 1 wherein a plurality of tag members similar to said rectangular tag member but bearing at least one different male or female symbol are collectively displayed on a supporting means to permit easy visual comparisons between all of the tag members so displayed.

11. The means of claim 10 wherein said symbol for said male parent of the seed being identified being colored, and said bars having the same color as the symbol for said male parent.

12. The means of claim 11 wherein said pair of symbols are horizontally disposed juxtapositioned bars and the colors of each juxtapositioned bar representing a given male or female parent is similarly colored on each tag member wherein such parent is represented.

13. The means of claim 10 wherein said supporting means is a page of a brochure and said tags are colored representations of said tag members.

14. The means of claim 1 wherein said pair of symbols are inbreds, and said seed being identified is a hybrid.

15. A means for identifying the performance characteristics of seed comprising, a rectangular tag member having a top, bottom and opposite sides, longitudinally disposed indicia means on said tag member with numeric indicia of progressively increasing magnitude, a plurality of separate bars on said tag member extending longitudinally adjacent said indicia means, each of said bars representing a different growing characteristic of the seed being identified, the length of each of said bars coinciding with a number or fractional number of said indicia means corresponding to a predetermined performance rating of the specific characteristics of said seed represented by each of said bars.

16. The means of claim 15 wherein said pair of symbols are horizontally disposed juxtapositioned bars.

17. The means of claim 16 wherein at least one of said juxtapositioned bars are colored, and said plurality of separate bars have the same color as said colored juxtapositioned bar.

18. The means of claim 15 wherein said longitudinally disposed indicia means, and said bars adjacent thereto are vertically positioned on said tag member.

19. The means of claim 15 wherein said indicia means is positioned adjacent one side of said tag member.

20. The means of claim 15 wherein a hybrid variety identification denomination is imposed on said tag member.

21. The means of claim 15 wherein a maturity rating of the hybrid seed being identified is imposed on said tag member.

22. The means of claim 15 wherein said tag member is affixed to a bag containing said seed.

23. The means of claim 15 wherein a plurality of tag members similar to said rectangular tag member are collectively displayed on a supporting means to permit easy visual comparison between all the tag members so displayed, with each of the tag members on said supporting means having a plurality of corresponding separate bars, at least some of which being of different lengths.

24. The means of claim 23 wherein said supporting means is a page of a brochure and said tags are colored representations of said tag members.

* * * * *